US005205663A

United States Patent [19]

Stephenson et al.

[11] Patent Number: 5,205,663

[45] Date of Patent: Apr. 27, 1993

[54] CAPSTAN BODIES IN PRINTER ROLLERS

[75] Inventors: Stanley W. Stephenson, Spencerport; William D. Goodwin, Rochester, both of N.Y.

[73] Assignee: Eastman Kodak Company, Rochester, N.Y.

[21] Appl. No.: 711,687

[22] Filed: Jun. 7, 1991

[51] Int. Cl.[5] ..... B41J 11/057

[52] U.S. Cl. ..... 400/662; 193/37; 492/25

[58] Field of Search ..... 101/93.02; 400/659, 400/661, 661.1, 662, 641, 636, 630; 193/37; 29/118, 119, 123

[56] References Cited

U.S. PATENT DOCUMENTS

| | | | |
|---|---|---|---|
| 635,609 | 10/1889 | Stickney | 400/554 |
| 731,834 | 6/1903 | Anderson | 400/659 |
| 888,556 | 5/1908 | Van Slyke | 400/661.2 |
| 1,336,379 | 8/1921 | Stickney | 70/212 |
| 4,316,314 | 2/1982 | Shlykov | 29/123 |
| 4,322,044 | 3/1982 | Bilek | 400/120 X |
| 4,621,271 | 11/1986 | Brownstein | 346/76 PH |
| 4,780,729 | 10/1988 | Murakami | 346/76 PH |
| 4,864,704 | 9/1989 | Hogan | 29/119 |
| 4,900,175 | 2/1990 | Ikeda et al. | 400/659 |
| 5,013,170 | 5/1991 | Haftmann | 400/659 |

FOREIGN PATENT DOCUMENTS

| | | | |
|---|---|---|---|
| 251988 | 1/1988 | European Pat. Off. | 400/662 |
| 3736729 | 5/1988 | Fed. Rep. of Germany | 400/662 |
| 480184 | 6/1916 | France | 400/659 |
| 95256 | 5/1987 | Japan | 400/120 |
| 138248 | 6/1987 | Japan | 400/662 |
| 1441348 | 6/1976 | United Kingdom | 400/659 |

OTHER PUBLICATIONS

"Rigid Foam Platen" (G. A. Duggins et al.), *IBM Technical Disclosure Bulletin*, vol. 17, No. 4, Sep. 1974 at p. 1115.

"Mechanisms of Color Formation on Thermo-Sensitive Paper" by A. Igarashi et al., *Advances in Non-Impract Printing Technologies for Computer and Office Applications*, Edited by J. Gaynor, Van Nostrand Reinhold Company, 1982, pp. 886-892.

"A Pulse Count Modulation: A Novel Head Drive Method for Thermal Printing" (M. D. Fiscella et al.), *Hard Copy and Printing Technologies* by K-I Shimazu, col. 1252, Proceedings SPIE, Feb. 13-14, 1990, Santa Clara, Calif., pp. 156-167.

*Primary Examiner*—Edgar S. Burr
*Assistant Examiner*—Eric P. Raciti
*Attorney, Agent, or Firm*—Raymond L. Owens

[57] ABSTRACT

A printing mechanism such as a thermal printer includes an elastomer coated platen having a circumference smaller than the printing length of an image to be reproduced on a print medium. The platen has a width which is wider than the width of the print medium. The platen includes a rigid central longitudinally-disposed shaft, and opposing end sections. Each end section extends under the nearest edge of the print medium from an associated end of the platen, and includes means for coupling a contacting print medium to a rotation of the shaft. In a preferred embodiment, the coupling means is formed of a non-elastomeric thin-walled cup either disposed near the surface of the platen within the elastomer coating or at the surface of the platen with a thin layer of fine grit particles formed thereon. Each thin-walled cup is fixedly connected to the shaft by a rigid torsion coupling member.

24 Claims, 2 Drawing Sheets

CAPSTAN BODIES IN PRINTER ROLLERS

FIELD OF THE INVENTION

The present invention relates to capstan bodies comprising small circumference print platens including an elastomeric coating surrounding a circumference of a rigid cylindrical core for use in printing mechanisms such as, for example, thermal printers.

BACKGROUND OF THE INVENTION

Platens are used in various printing machines to support a print medium (e.g., paper) while the printing machine produces the desired text and/or graphics on the print medium. Platens are generally made with a rigid cylindrical central shaft and a semi-rigid compliant printing layer surrounding the outer surface of the shaft. Such compliant printing surface is formed of a material, or a composition of materials, that provides sufficient friction to control the movement of the print medium thereon as the platen rotates about its longitudinal axis. In typewriting machines, the semi-rigid compliant printing layer is chosen to also provide sound deadening qualities and minimal deformation a the type forming the characters impacts the print medium. In this regard see, for example, U.S. Pat. No. 731,834 (F. F. Anderson), which issued on Jun. 23, 1903, U.S. Pat. No. 4,900,175 (H. Ikeda et al.), which issued on Feb. 13, 1990, and the article entitled "Rigid Foam Platen" by G. A. Duggins et al. in the IBM Technical Disclosure Bulletin, Vol. 17, No. 4, September 1974 at page 1115.

Platens are also used in non-impact printers such as ink-jet printers. Non-impact printers are so called because their printing mechanism does not touch the paper or print medium. More particularly, ink-jet printers use electrically charged ink droplets that are sprayed between electrically charged deflection plates to direct the ink droplets and form the complete image on the paper disposed on a platen. Thermal printers, on the other hand, use a specially-coated heat-sensitive print medium, such as paper, which moves between a platen and a thermal print head. The thermal print head comprises, for example, a linear array of heating elements (forming individual pixels) which contact the heat-sensitive print medium. Each of the heating elements is then energized to provide a selectively predetermined amount of heat. The heat from each of the energized heating elements reacts with the heat-sensitive print medium therebeneath to form a separate pixel of the complete image. The next line of pixels are formed by advancing the platen and the print medium thereon by a predetermined distance passed the thermal print head. In certain heat-sensitive or thermo-sensitive papers, as explained in the article entitled "Mechanisms of Color Formation On thermo-sensitive Paper" by A. Igarashi et al. in the book *Advances In Non-Impact Printing Technologies For Computer and Office Applications,* Edited by J. Gaynor, Van Nostrand Reinhold, Company, 1982, at pages 886–892, a thermo-sensitive layer of certain components is provided on the paper. The subsequent predetermined heating of each pixel area of the thermo-sensitive layer (via a heater element on a thermal print head) diffuses the dyes into a dye receiving layer to produce color formation of the complete image.

In certain thermal printers, a dye receiving member is fed onto a platen and then a dye bearing web is placed in contact with the dye receiving member. As the platen rotates, the dye receiving member and the dye bearing web thereon are brought under the thermal print head. Heat from the thermal print head transfers a predetermined amount of dye from the dye bearing web to the dye receiving member. The dye receiving member and dye bearing web are advanced a predetermined number of increments until a complete image layer has been deposited. In these applications, the overall image may require multiple dye layers to be deposited on the dye receiving member, such as in the creation of continuous tone sublimation dye images. The overall image quality where multiple overlapping dye layers are used is dependent on the registration of each of the dye layers to each of the other overlapping dye layers.

The article entitled "Pulse Count Modulation: A Novel Head Drive Method For Thermal Printing" by M. D. Fiscella et al. in the publication *Hard Copy and Printing Technologies,* Volume 1252, Proceedings of the SPIE, Feb. 13–14, 1990, Santa Clara, Calif. at pages 156–167, discusses a continuous tone thermal dye diffusion printer designed by the Eastman Kodak Company using a pulse count modulation thermal print head drive. In the printing process, a hot heater element of the thermal print head diffuses dye from a donor sheet into a dye receiving member (e.g., resin coated paper) to form a pixel of a complete image. In thermal dye diffusion printing, the amount of dye transferred to a pixel, and the optical density level of the pixel, are a function of the amount of heat produced at a given heater element and the length of time the heater element is hot.

In certain printers such as continuous tone thermal dye diffusion printers, several dye layers must be deposited to produce the complete image. Therefore, after a dye layer has been deposited, the dye receiving member is rewound for each successive dye layer. It is desirable that each successive dye layer must precisely overlay the preceding dye layers for optimum image quality. Because prior art platens are typically covered with an elastomer, a certain amount of mis-registration results from the rewinding operation.

Additionally, in certain printers it is desirable that the diameter of the rotating platen be as small a possible. With small diameter elastomeric coated platens, it is usually impossible to fixedly clamp the dye receiving member to the platen because the circumference of the platen is smaller than the length of the image to be produced. In a first know embodiment using small diameter elastomeric coated platens, the dye receiving member is brought to a starting position across the platen, and a dye layer is printed on the dye receiving member. For each succeeding dye layer application, the platen and the dye receiving member are counter-rotated the same degree, or amount of rotation, as was performed during printing of each prior dye layer. It is found that with the above-described counter-rotating method, the dye receiving member does not return to the exact same starting position each time. This mis-registration is due to the compliant nature of the elastomeric coating of the platen.

In a second known embodiment using small diameter platens, the dye receiving member movement is controlled by external, hard surface, capstan drive print rollers that eliminate the mis-registration found with elastomeric surfaced platens. With such external print rollers, the overall printing mechanism is necessarily more complex and expensive. Additionally, such print mechanism produced a large non-printed area on the dye receiving member, which area is at least equivalent to the distance between the printing "nip" (where the dye receiving member engages the platen and the thermal print head) and the capstan "nip" (where the dye receiving member engages the external print roller).

It is desirable to have a simple and inexpensive printer which provides the same quality of registration as seen in the capstan drive print mechanisms while avoiding the need for capstan roller mechanisms.

SUMMARY OF THE INVENTION

The present invention is directed to providing a simple and inexpensive printer which provides a quality of registration between dye layers approaching the quality of a capstan drive print mechanisms without the need for capstan drive rollers. More particularly, the present invention relates to a printing mechanism for reproducing an image on a print medium. The printing mechanism comprises a cylindrical rotatable platen for contacting and supporting the print medium on which the image is to be reproduced. The platen comprises a predetermined circumference and longitudinal length, a central longitudinal section, and a first and a second end section. The circumference of the platen is smaller than a printing length of the image to be reproduced. The predetermined longitudinal length is wider than a width of a print medium. The central longitudinal section of the platen includes an elastomer coated cylindrical printing surface with a predetermined axial compliancy. The first and second end sections each extend from an opposite end of the elastomer coated cylindrical printing surface. Each of the end sections comprises means for providing a significantly higher torsional rigidity than that of the elastomer coated printing surface, an axial compliancy which substantially approximates the predetermined axial compliancy of the elastomer coated printing surface, and a length which extends under a nearest edge of the print medium when the print medium is placed on the platen.

In a preferred embodiment the printing mechanism is a thermal printer comprising a cylindrical rotatable platen, and a thermal print head. The cylindrical rotatable platen contacts and supports a print medium on which an image is to be reproduced. The platen comprises a circumference which is smaller than a printing length of the image to be reproduced, and a predetermined longitudinal length which is wider than a width of a print medium. The platen further comprises a central longitudinal section including a elastomer coated cylindrical printing surface with a predetermined axial compliancy, and a first and a second end section extending from an opposite end of the elastomer coated cylindrical printing surface. Each end section comprises (1) means for providing a significantly higher torsional rigidity than that of the elastomer coated printing surface, (2) an axial compliancy which substantially approximates the predetermined axial compliancy of the elastomer coated printing surface, and (3) a length which extends under a nearest edge of the print medium when the print medium is placed on the platen. The thermal print head comprises a plurality of heating elements disposed in a predetermined pattern. The plurality of heating elements are arranged to selectively contact the print medium on the platen during a printing process.

The invention will be better understood from the following more detailed description taken with the accompanying drawings and claims.

The drawings are not necessarily to scale.

DETAILED DESCRIPTION

Figure 1:
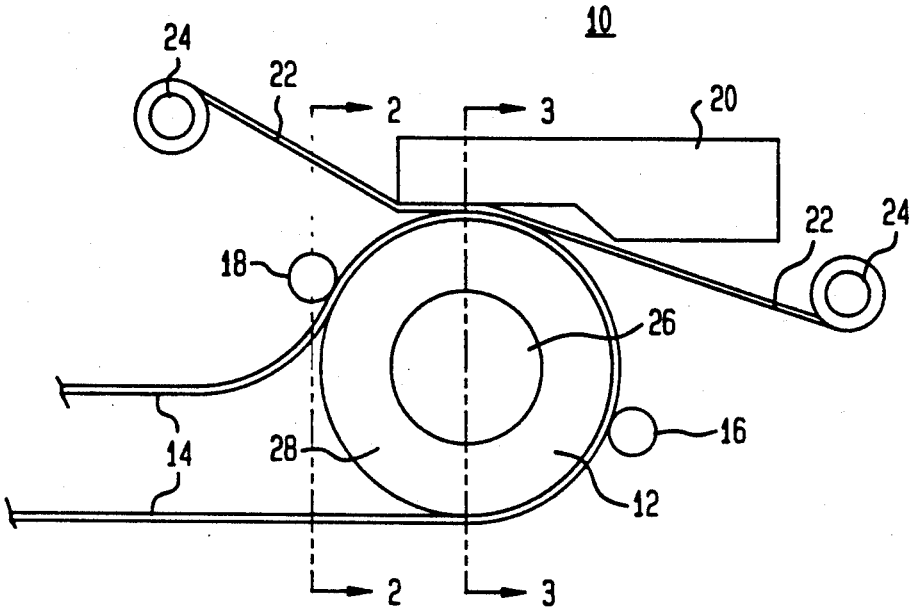
FIG. 1 is a cross-sectional side view through the center of a continuous tone dye diffusion thermal printer in accordance with the present invention.

Referring now to FIG. 1, there is shown a cross-sectional view of a thermal head and capstan apparatus 10 for a continuous tone dye diffusion thermal printer in accordance with the present invention. The apparatus 10 comprises a platen 12, a dye receiving member (e.g., paper) 14, a first contact roller 16, a second contact roller 18, a thermal print head 20, and a dye bearing web 22 running between a pair of reels 24. The platen 12 comprises a central rigid core or shaft 26 made of steel or other rigid material surrounded by a layer 28 of an elastomeric material such as silicon rubber or a urethane derivative. The dye receiving member 14 is wrapped around a portion of the outer surface of the elastomeric layer 28 of the platen 12 at least in the area between the first and second contact rollers 16 and 18 and adjacent the thermal print head 20. A first side of the dye bearing web 22 is positioned in contact with the exposed surface of the dye receiving member 14, and the thermal print head 20 is then placed in contact with the opposing side of the web dye bearing 22. The dye receiving member 14 and the dye bearing web 22 comprise a print media for reproducing a complete image on the dye receiving member 14.

In operation, the dye receiving member 14 is fed around at least a portion of the outer surface of the platen 12 including the area between the first and second contact rollers 16 and 18 and the area adjacent thermal print head 20. The contact rollers 16 and 18, the elastomeric layer 28 on platen 12, and any tension on the dye receiving member 14 ensure that the dye receiving member 14 is maintained in contact with the outer surface of the elastomeric layer 28 of the platen 12. The dye bearing web 22 is then positioned adjacent to the dye receiving member 14, and the thermal print head 20 is placed in forced contact with the dye bearing web 22. In other words, the two parts of the thermal print media 14 and 22 are passed between a print "nip" (the slightly compressed area) formed between the thermal print head 20 and the platen 12. A plurality of heating elements (not shown) form, for example, a linear array of heating elements of the thermal print head 20 which are positioned in contact with the dye bearing web 22. Once the above-described configuration is achieved, the printing operation is started.

In the printing operation, each of the plurality of heating elements of the linear array of heating elements of the thermal print head 20 are individually energized depending on the pattern of a desired image (or dye) layer to be reproduced. More particularly, the thermal print head 20 can consist of a linear arrangement of a plurality of resistive elements (not shown) which are selectively energized so as to cause different quantities of dye to be transferred onto the dye receiving member 14 as the thermal print media 14 and 22 pass ®s through the print "nip". In other words, the amount of heat from each heating element causes a predetermined amount of dye from the dye bearing web 22 therebeneath to be transferred to the dye receiving member 14 to form a separate image pixel of the image layer on the dye receiving member 14. It is to be understood that when a heating element is not selectively heated, no dye will be transferred to the dye receiving member 14 from the dye bearing web 22 during the production of that image pixel. When all of the image pixels of a line have been formed across the dye receiving member 14, the dye receiving member and the dye bearing web 22 are moved forward in a first direction by a predetermined distance to permit the next adjacent line of image pixels of an overall image layer to be formed in a similar manner. The image layer of a desired complete image is completed when all of the adjacent lines of image pixels have been transferred to the dye receiving member 14 during one pass beneath the thermal print head 20.

In certain thermal printers, such as where continuous tone sublimation dye images are formed, overlaid color layers must be printed to form the complete image. With such thermal printers, it is necessary to rewind the dye receiving member 14 in order to overlay each successive image layer on each of the prior formed dye layer or layers. It must be understood that the quality of the complete image is dependent on the registration of each dye layer with each of the other dye layers.

For resistive element printing, the contact force of the thermal print head 20 on the dye bearing web 22 and the dye receiving member 14 can be in the order of 2 to 4 pounds of force per linear inch of the thermal print head 20. For thermal print heads 20 having a length of from 8 to 10 inches, the resulting head forces on the platen 12 and print media 14 and 22 are sufficient to induce a worst-case mis-registration between successive image layers of from 0.005 to 0.020 inches. In high resolution printing, where heating elements of the thermal print head 20 are 0.005 inches square, the above data represents pixel mis-registration on the order of from 1 to 4 pixels. In certain applications, this results in unacceptable quality of the complete images.

Additionally, in the case of small diameter platens 12, which typically have an outer diameter of between 20 and 25 millimeters, it is impossible to fixedly clamp the dye receiving member 14 to the platen 12 to avoid mis-registration because the length of the complete image to be printed is greater than the circumference of the platen 12. When the dye receiving member 14 is rewound back to the starting position of a complete image by counter-rotating the platen 12 by a same degree of rotation as was accomplished during printing to form a successive image layer, a mis-registration generally occurs due to the compliant nature of the elastomeric layer 28 on platen 12. It must be understood that to minimize mis-registration from other sources during the rewinding operation when the thermal print head 20 is lifted (by means not shown) from the print media 14 and 22, the dye receiving member 14 must be kept in frictional contact with the platen 12. Such frictional contact minimizes any slippage between the dye receiving member 14 and the platen 12 during the rewinding operation. The continued frictional contact of the dye receiving member 14 with the platen 12 is accomplished by the use of the contact rollers 16 and 18 which are disposed on either side of the print "nip" area adjacent the thermal print head 20.

Mis-registration between image layers could be substantially avoided by using external, hard-surface, rollers (not shown) which feed and rewind the dye receiving member 14, as is known in the prior art such as U.S. Pat. No. 4,532,525. Such external rollers produce a more complex and expensive capstan drive mechanism in the printer. The present inventive thermal print head and capstan arrangement 10 uses a torsionally rigid, yet flexible, outer surface at the opposing ends of the platen 12 to achieve the same quality of registration as seen in the capstan drive mechanisms using external, hard-surface, rollers as will now be described.

Figure 2:
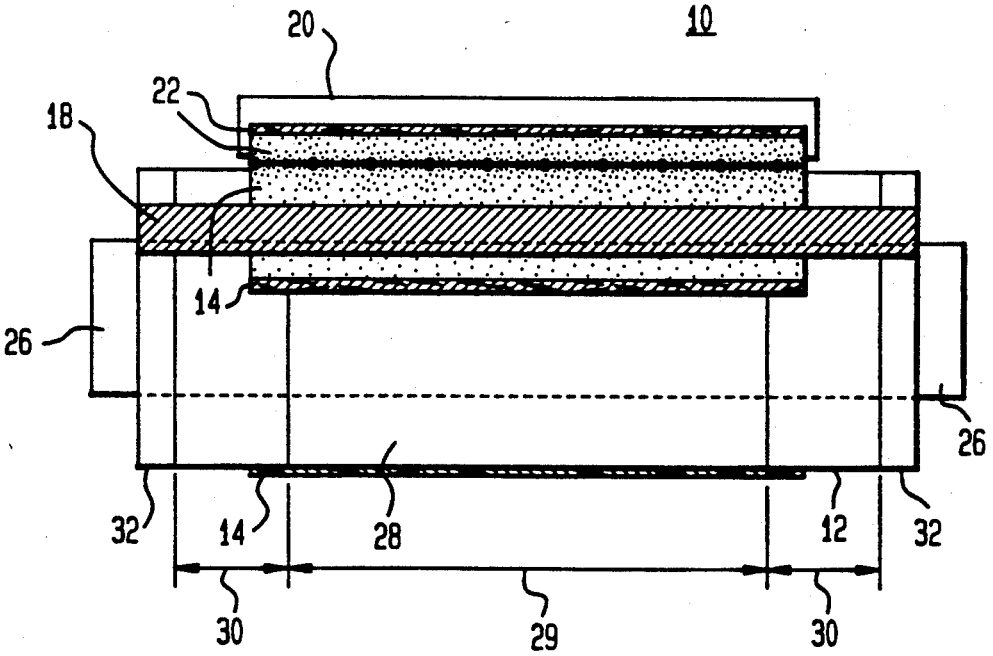
FIG. 2 is a front view along line 2—2 of the thermal printer of FIG. 1.

Referring now to FIG. 2, there is shown a front view along dashed line 2—2 of FIG. 1 which shows the platen 12 with its shaft 26 and elastomeric layer 28, the dye receiving member 14, the second contact roller 18, the thermal print head 20, and the dye bearing web 22. In the thermal print head and capstan arrangement 10, the thermal print head 20 is slightly wider than the width of the print media comprising receiver 14 and web 22. The platen 12 is wider than both the print head 20 and the thermal print media. The platen 12 is shown as comprising the elastomeric layer 28 disposed along a predetermined central section 29 thereof (illustrated by the long horizontal line with arrows on both ends), first and second torsionally rigid sections 30 disposed adjacent opposite ends of the platen 12, and first and second rigid torsion couplings 32 disposed at the opposite ends of the platen 12 which are coupled to the first and second torsionally rigid sections 30 (illustrated by relatively short horizontal lines each having an arrow at both ends thereof), respectively. The predetermined central section 29 is narrower than, and is positioned under, a central portion of the dye receiving member 14. Each of the first and second torsionally rigid sections 30 have a length which extends under the nearest edge of the dye receiving member 14 and is coupled to the nearest end of the predetermined central section 29. The shaft 26 of the platen 12 extends beyond the ends of the first and second rigid torsion couplings 32 for connection to a drive means (not shown in FIG. 2).

Figure 3:
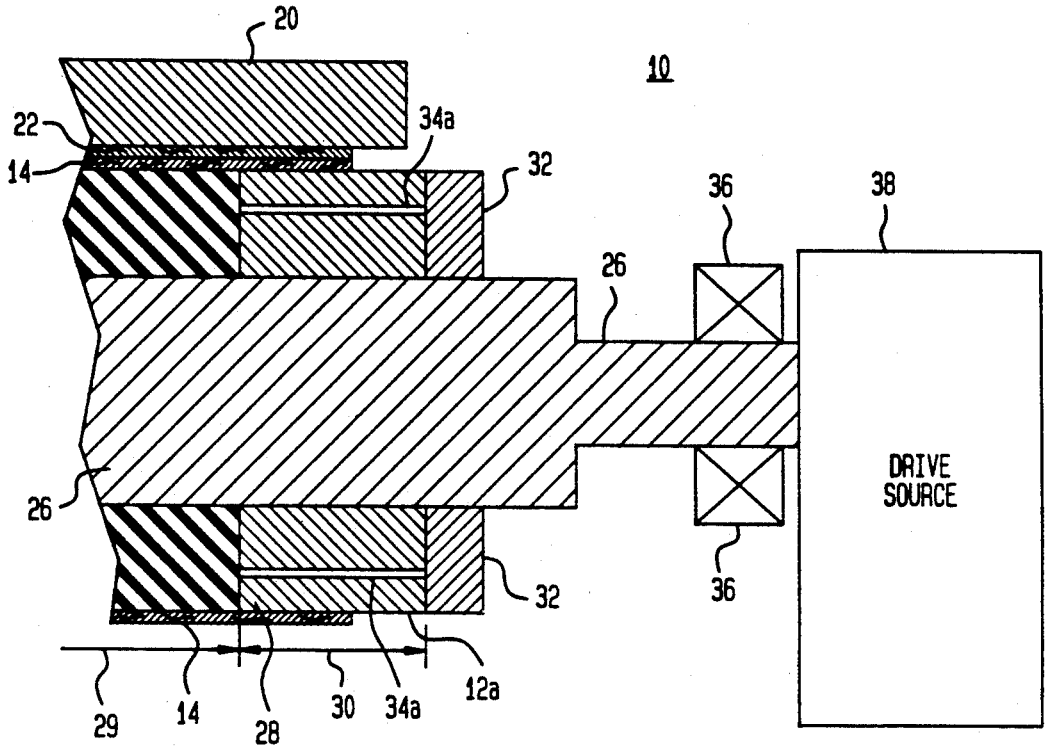
FIG. 3 is a partial right-hand front sectional view along line 3—3 of the thermal printer of FIG. 1.

Referring now to FIG. 3, there is shown an expanded view of a right-hand portion of the thermal printhead and capstan arrangement 10 of FIG. 2 taken along dashed line 3—3 of FIG. 1. This expanded view shows a structure of a platen **12*a* which can be used as the platen 12 in FIGS. 1 and 2. Each of the torsionally rigid end sections 30 of platen 12*a* comprises a thin wall cylindrical end cup (or member) 34*a* that extends longitudinally inwards from an associated end of the platen 12*a* and is near the surface of an elastomeric layer 28*a* which is an extension of the elastomeric layer 28 of the central section 29. Additionally, the thin wall longitudinal cylinder of each end cup 34*a* extends under the nearest edge of the dye receiving member 14**.

The purpose of the end cups **34*a* is to closely couple the motion of the dye receiving member 14 (engaging the elastomeric layer 28 and 28*a* of platen 12*a*) to the motion of the rigid shaft (core) 26 in the center of the platen 12*a*. This is done by the use of a rigid torsion coupling member 32 located at each end of the platen 12*a* and outside of the printing area formed by dye receiving member 14 and the thermal print head 20. Each end cup 34*a* and torsion coupling member 32 structure is, for example, precision machined as one piece, and an elastomer is then molded inside the cups to form elastomeric layer 28. The resulting end cup 34***a* and the associated rigid torsion coupling member 32 structures are then bonded to the shaft 26. The remainder of the elastomeric layer 28 and 28*a* forming the outer surface of platen 12*a* is molded between the two end cup 34*a* and torsion coupling member 32 structures including the central section 29. During the secondary molding process of adding the elastomeric layer 28, a thin "skin" of elastomer 28*a* covers the outside body of the end cups 34*a* to provide a high traction surface. In one embodiment, using an elastomer having a value of approximately 50 shore A durometer, the material of the end cups 34*a* is, for example, polycarbonate, 0.012 inches thick and extending 0.75 inches under the edges of the dye receiving member 14. In such design, the thickness of the polycarbonate matches the compliance of the elastomeric layer 28 when the thermal print head 20 is loaded against the print media (receiver 14 and web 22) and the platen 12*a*.

Figure 4:
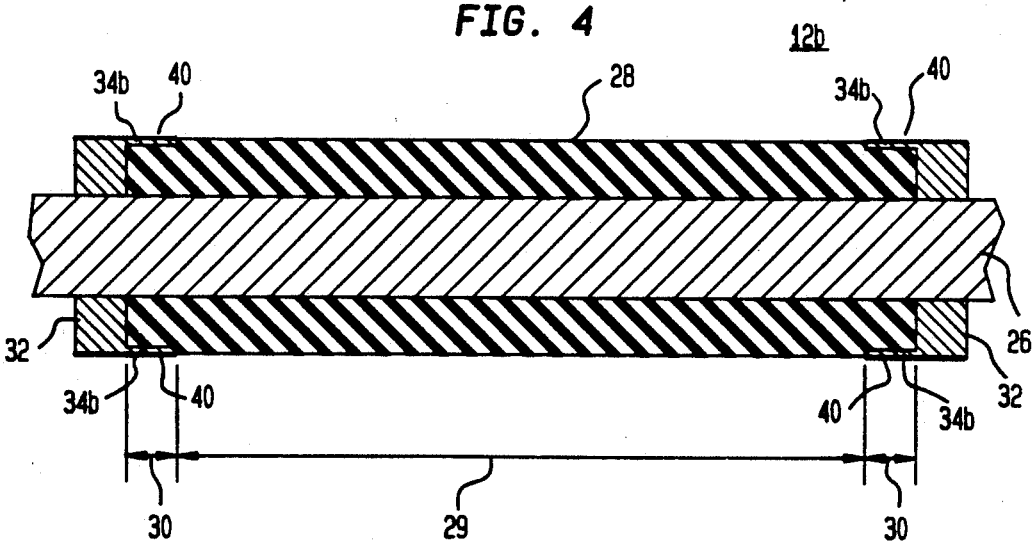
FIG. 4 is a cross-sectional view through the center of an alternative arrangement of a platen for use in the thermal printer shown in FIG. 3.

Referring now to FIG. 4, there is shown a cross-sectional view through the center of an alternative arrangement of a platen 12*b* for use as the platen 12 in the thermal printhead and capstan arrangement 10 of FIGS. 1 and 2. Portions of the platen 12*b* which are essentially the same as corresponding portions of the platen 12*a* have the same reference number, and portions which are similar have the same reference number with a "b" thereafter instead of an "a". The platen 12*b* of FIG. 4 includes the shaft 26, the elastomeric layer 28, end cups 34*b* and torsion coupling members 32, and a layer 40 of grit particles formed on the end cups 34*b* and torsion coupling members 32. In the arrangement of FIG. 4, the outside diameter of the end cups 34*b* and torsion coupling members 32 are made slightly larger than the desired outside diameter of the platen 12*b*. It is to be understood that the end cups 34*b* and torsion coupling members 32 can be formed of a plastic like polycarbonate or a metal. After the end cups 34*b* and torsion coupling members 32 are coupled to the shaft 26, the elastomer coating 28 is molded on the shaft 26 between and under the end cups 34*b*. The outer surface of the elastomer coating 28 and both the end cups 34*b* and torsion coupling members 32 are then ground to the desired outside diameter using any suitable technique.

The layer 40 of grit particles is then formed on the outer surface of the end caps 34*b* and torsion coupling members 32 using any suitable method. A first method is to deposit an adhesive on the outer surface of the end cups 34*b* and torsion coupling members 32, and then deposit the grit particles thereon to form the layer 40. In a second preferred method, the hard grit particles are combined or carried with a low temperature metal (binding metal) in a powder form. This powder is then plasma sprayed (or flame sprayed) onto the outer surface of the end cups 34*b* and torsion coupling members 32. More particularly, the powder is blown through an high current spark gap (e.g., a welding gun or torch) (not shown) which turns the powder into a molten powdery liquid. When the molten powdery liquid is sprayed onto the outer surface of the end cups 34*b* and torsion coupling members 32, it solidifies and bonds to the outer surface to form the very thin layer 40. Because only a small amount of the molten material is deposited onto the end cups 34*b* and torsion coupling members 32, there is insufficient material to melt the cups 34*b* and members 32 if they are made of plastic. The end result is that the platen 12*b* has substantially the same outside diameter throughout because the layer 40 is only approximately a few ten thousands of an inch thick. Therefore, the actual diameter buildup of the layer 40 is very small. What the layer 40 does is provide a surface that is like a fine sandpaper. When the print media (e.g., paper) is placed on the torsionally rigid sections 30, the grit particles protrude into the print media and couples the movement of the print media on platen 12*b* to the movement of the torsionally rigid sections 30.

It is to be understood that the specific embodiments described herein are intended merely to be illustrative of the spirit and scope of the invention. Modifications can readily be made by those skilled in the ar consistent with the principles of this invention. For example, arrangements other than those including thin cylindrical end cups 34*a* and 34*b* and rigid torsion couplings 32 can be used which still allow for compliance of the platen 12 to compensate for thermal print head 20 irregularities, and/or provide a more torsionally rigid coupling of the dye receiving member 14 to the rigid core shaft 26. Additionally, the principles of the present platen arrangement have been described to provide improved color registration in continuous tone dye sublimation printers. Still further, it is to be understood that the present platen design can be used in other types of printers, even where rewinding of a print medium is not necessary since good registration between lines is achieved during the printing of a single image. More particularly, the present platen arrangement can be used in printing mechanisms which produce, for example, graphics where rewinding of a print media to an degree is required while avoiding mis-registration between successive image patterns.

What is claimed is:

1. A printing mechanism for reproducing an image on a print medium comprising:

a cylindrical rotatable platen for contacting and supporting the print medium on which the image is to be reproduced, the platen comprising:

a circumference which is smaller than a printing length of the image to be reproduced;

a predetermined longitudinal length which is wider than a width of a print medium;

a central longitudinal section including a cylindrical elastomer printing surface with a predetermined compliancy in a radial direction; and a first and a second end section, each end section extending from an opposite end of the cylindrical elastomer printing surface, each of the end sections comprising means for providing a significantly higher torsional rigidity than that of the cylindrical elastomer printing surface, a compliancy in a radial direction which approximates the predetermined compliancy in a radial direction of the cylindrical elastomer printing surface, and a length which extends under a nearest edge of the print medium when the print medium is placed on the platen.

2. The printing mechanism of claim 1 further comprising at least one contact roller located so as to maintain the print medium in contact with the cylindrical printing surface of the platen between printing time periods.

3. The printing mechanism of claim 1 wherein:

the platen further comprises a rigid longitudinal central core forming a shaft which is coupled to, and extends beyond, the edges of the first and second end sections; and the mechanism further comprises a driving means coupled to the shaft of the platen for selectively rotating the platen by predetermined amounts.

4. The printing mechanism of claim 1 wherein the first and second end sections each comprise a thin wall longitudinally-positioned cylinder in contact with an elastomer material for forming an extension of the cylindrical printing surface of the central section which extends under the adjacent edge of the print medium placed on the platen, the thin wall cylinder having a length and a thickness such that deflection in a radial direction of the thin wall cylinder approximates the deflection in a radial direction of the cylindrical elastomer central section and the elastomer material in the end section.

5. The printing mechanism of claim 4 wherein:

the platen further comprises a rigid longitudinal shaft which is coupled to, and extends beyond, the edges of the first and second end sections; and the first and second end sections comprise coupling means for fixedly coupling the thin wall cylinders to the rigid central shaft of the platen as the shaft is rotated by external means.

6. The printing mechanism of 5 further comprising:

at least one contact roller located substantially parallel to the cylindrical printing surface so as to maintain the print medium in contact with the printing surface of the platen between printing time periods, each contact roller having a length which approximates the predetermined longitudinal length of the platen; and the coupling means is formed of a rigid material and includes a circumference which provides a cylindrical surface for contacting end areas of the at least one contact roller contacting the platen when the print medium is not disposed between the platen and the at least one contact roller.

7. The printing mechanism of claim 4 wherein the thin wall cylinder of each of the first and second end sections includes an outside surface having a elastomeric layer thereon, a circumference of the elastomeric layer matching a circumference of the central section of the platen and forming a high-friction coupling between the thin wall cylinder and the print medium placed on a portion of the end section.

8. The printing mechanism of claim 4 wherein the thin walled cylinder of the first and second end sections includes an outside surface having a layer of grit particles deposited thereon, a circumference of the layer of grit particles substantially matching a circumference of the central section of the platen and forming a high-friction coupling between the thin wall cylinder and the print medium placed on a portion of the end section.

9. The printing mechanism of claim 1 wherein the printing mechanism is a thermal printer further comprising:

a thermal print head comprising a plurality of heating elements disposed in a predetermined pattern, the plurality of heating elements being arranged to selectively contact the print medium on the platen during a printing process.

10. The printing mechanism of claim 9 further comprising at least one contact roller located so as to maintain the print medium in contact with the printing surface of the platen between printing time periods.

11. The printing mechanism of claim 9 wherein:

the platen further comprises a rigid longitudinal central core forming a shaft which is coupled to, and extends beyond, the edges of the first and second end sections; and the mechanism further comprises a driving means coupled to the shaft of the platen for selectively rotating the platen by predetermined amounts.

12. The printing mechanism of claim 9 wherein the first and second end sections each comprise a thin wall longitudinally-positioned cylinder in contact with an elastomer material for forming an extension of the cylindrical printing surface of the central section which extends under the adjacent edge of the print medium placed on the platen, the thin wall cylinder having a length and a thickness such that deflection in a radial direction of the thin wall cylinder approximates the deflection in a radial direction of the cylindrical elastomer central section and the elastomer material in the end section.

13. The printing mechanism of claim 12 wherein:

the platen further comprises a rigid longitudinal shaft which is coupled to, and extends beyond, the edges of the first and second end sections; and the first and second end sections comprise coupling means for fixedly coupling the thin wall cylinders to the rigid central shaft of the platen as the shaft is rotated by external means.

14. The printing mechanism of claim 13 further comprising:

at least one contact roller located substantially parallel to the cylindrical printing surface to maintain the print medium in contact with the printing surface of the platen between printing time periods, each contact roller including a length which approximates the predetermined longitudinal length of the platen; and the coupling means is formed of a rigid material and includes a circumference which provides a cylindrical surface for contacting end areas of the at least one contact roller contacting the platen when the print medium is not disposed between the platen and the at least one contact roller.

15. The printing mechanism of claim 12 wherein the thin wall cylinder of each of the first and second end sections includes an outside surface having an elastomeric layer thereon, a circumference of the elastomeric layer matching a circumference of the central section of the platen and forming a high-friction coupling between the thin wall cylinder and the print medium placed on a portion of the end section.

16. The printing mechanism of claim 12 wherein the thin walled cylinder of the first and second end sections includes an outside surface having a layer of grit particles deposited thereon, a circumference of the layer of grit particles substantially matching a circumference of the central section of the platen and forming a high-friction coupling between the thin wall cylinder and the print medium placed on a portion of the end section.

17. A thermal printing mechanism for reproducing an image on a print medium comprising:

a cylindrical rotatable platen for contacting and supporting the print medium on which the image is to be reproduced, the platen comprising (a) a circumference which is smaller than a printing length of the image to be reproduced, (b) a predetermined longitudinal length which is wider than a width of a print medium, (c) a central longitudinal section including a cylindrical elastomer printing surface with a predetermined compliancy in a radial direction, and (d) a first and a second end section, each end section extending from an opposite end of the cylindrical elastomer printing surface, and comprises (1) means for providing a significantly higher torsional rigidity than that of the cylindrical elastomer printing surface, (2) a compliancy in a radial direction which approximates the predetermined compliancy in a radial direction of the cylindrical elastomer printing surface, and (3) a length which extends under a nearest edge of the print medium when the print medium is placed on the platen; and a thermal print head comprising a plurality of heating elements disposed in a predetermined pattern, the plurality of heating elements being arranged to selectively contact the print medium on the platen during a printing process.

18. The printing mechanism of claim 17 further comprising at least one contact roller located so as to maintain the print medium in contact with the printing surface of the platen between printing time periods.

19. The printing mechanism of claim 17 wherein:

the platen further comprises a rigid longitudinal central core forming a shaft which is coupled to, and extends beyond, the edges of the first and second end sections; and the mechanism further comprises a driving means coupled to the shaft of the platen for selectively rotating the platen by predetermined amounts.

20. The printing mechanism of claim 17 wherein the first and second end sections each comprise a thin wall longitudinally-positioned cylinder in contact with an elastomer material for forming an extension of the cylindrical printing surface of the central section which extends under the adjacent edge of the print medium placed on the platen, the thin wall cylinder having a length and a thickness such that deflection in a radial direction of the thin wall cylinder approximates the deflection in a radial direction of the cylindrical elastomer central section and the elastomer material in the end section.

21. The printing mechanism of claim 20 wherein:

the platen further comprises a rigid longitudinal shaft which is coupled to, and extends beyond, the edges of the first and second end sections; and the first and second end sections comprise coupling means for fixedly coupling the thin wall cylinders to the rigid central shaft of the platen as the shaft is rotated by external means.

22. The printing mechanism of claim 21 further comprising:

at least one contact roller located substantially parallel to the cylindrical printing surface to maintain the print medium in contact with the printing surface of the platen between printing time periods, each contact roller having a length which approximates the predetermined longitudinal length of the platen; and the coupling means is formed of a rigid material and has a circumference which provides a cylindrical surface for contacting end areas of the at least one contact roller contacting the platen when the print medium is not disposed between the platen and the at least one contact roller.

23. The printing mechanism of claim 21 wherein the thin wall cylinder of each of the first and second end sections comprises an outside surface having an elastomeric layer thereon, a circumference of the elastomeric layer matching a circumference of the central section of the platen and forming a high-friction coupling between the thin wall cylinder and the print medium placed on a portion of the end section.

24. The printing mechanism of claim 21 wherein the thin walled cylinder of the first and second end sections comprises an outside surface having a layer of grit particles deposited thereon, a circumference of the layer of grit particles substantially matching a circumference of the central section of the platen and forming a high-friction coupling between the thin wall cylinder and the print medium placed on a portion of the end section.

* * * * *